US008192908B2

(12) United States Patent
Kamoto et al.

(10) Patent No.: US 8,192,908 B2
(45) Date of Patent: Jun. 5, 2012

(54) CARRIER, DEVELOPER, DEVELOPMENT DEVICE, IMAGE FORMING APPARATUS AND IMAGE FORMING METHOD

(75) Inventors: Takanori Kamoto, Yamatokoriyama (JP); Tadashi Iwamatsu, Nara (JP); Nobuyuki Yoshioka, Ikeda (JP); Yoshinori Mutoh, Kitakatsuragi-gun (JP); Hiroyuki Hirakawa, Tenri (JP); Takashi Hara, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 900 days.

(21) Appl. No.: 12/128,148

(22) Filed: May 28, 2008

(65) Prior Publication Data

US 2008/0299471 A1 Dec. 4, 2008

(30) Foreign Application Priority Data

May 29, 2007 (JP) ..... 2007-142621

(51) Int. Cl.
*G03G 9/08* (2006.01)

(52) U.S. Cl. ..... 430/111.1; 430/111.32; 399/252

(58) Field of Classification Search ..... 430/111.1, 430/111.32; 399/252
See application file for complete search history.

(56) References Cited

U.S. PATENT DOCUMENTS

| | | | | |
|---|---|---|---|---|
| 5,627,001 | A * | 5/1997 | Vail | 430/111.32 |
| 6,284,421 | B1 | 9/2001 | Matsuzaki et al. | |
| 2004/0023142 | A1 * | 2/2004 | Hulin et al. | 430/111.1 |
| 2004/0115550 | A1 | 6/2004 | Sugiura et al. | |

FOREIGN PATENT DOCUMENTS

| | | |
|---|---|---|
| CN | 1487372 A | 4/2004 |
| JP | 62-011864 | 1/1987 |
| JP | 64-029859 | 1/1989 |
| JP | 01-284862 | 11/1989 |
| JP | 02-008860 | 1/1990 |
| JP | 4-204666 | 7/1992 |
| JP | 5-49982 | 1/1993 |
| JP | 5-49982 | 7/1993 |
| JP | 01-284862 | 11/1999 |
| JP | 2004-109678 | 4/2004 |

* cited by examiner

*Primary Examiner* — Mark A Chapman
(74) *Attorney, Agent, or Firm* — Nixon & Vanderhye P.C.

(57) ABSTRACT

A carrier of the present invention is used in a developer including a toner which includes at least a binder resin and an organic colorant, and the carrier has a core and a coating formed on the surface of the core, the coating including (i) a charge control agent for controlling a charge whose polarity is the same as a polarity of a charge controlled by a charge control agent included in the toner, and (ii) a conductive particles. The use of the carrier of the present invention enables: prevention of decrease in the charging amount of the toner which includes at least a binder resin and an organic colorant; and formation of a stable, high-resolution, high-quality image which has very few image defects such as a photographic fog.

15 Claims, 1 Drawing Sheet

CARRIER, DEVELOPER, DEVELOPMENT DEVICE, IMAGE FORMING APPARATUS AND IMAGE FORMING METHOD

This Nonprovisional application claims priority under 35 U.S.C. §119(a) on Patent Application No. 142621/2007 filed in Japan on May 29, 2007, the entire contents of which are hereby incorporated by reference.

FIELD OF THE INVENTION

The present invention relates to (i) a carrier for use in an electrophotographic printing method, in which method an electrostatic latent image formed on an image bearing member is developed into a visible image, (ii) a developer which contains the carrier, (iii) a development device using the developer, (iv) an image forming apparatus and (v) an image forming method.

BACKGROUND OF THE INVENTION

Significant advancement of office automation equipment in recent years has helped to promote the widespread use of image forming apparatuses, such as a copier, a printer and a facsimile machine, which apparatuses perform an image forming process by means of an electrophotographic printing method. Such apparatuses that employ the electrophotographic printing method generally perform a charging step, an exposure step, a development step, a transfer step, a cleaning step and a fixing step so that an image is formed. Specifically, in the charging step, the surface of a photoreceptor, i.e. an image bearing member, is uniformly charged in darkness. In the exposure step, projection of signal light corresponding to an image to be formed on the charged photoreceptor removes the charge of the portion exposed, so that an electrostatic image (an electrostatic latent image) is formed on the surface of the photoreceptor. In the development step, the electrostatic image on the surface of the photoreceptor is supplied with a toner for developing an electrostatic image (which toner is hereinafter referred to as "toner" unless otherwise indicated) so that a toner image (visible image) is formed. In the transfer step, a recording material such as paper and sheet is allowed to contact the toner image formed on the surface of the photoreceptor. In addition, corona discharge is performed on the side of the recording material which side is opposite from the side that contacts the toner image so that charge having a polarity opposite the polarity of the toner is provided for the recording material. This allows the toner image to be transferred onto the recording material. In the fixing step, the toner image on the recording material is fixed by heating, pressing, and/or other means. In the cleaning step, toner which remains on the surface of the photoreceptor without being transferred onto the recording material is collected. Through the above steps, image forming apparatuses which employ the electrophotographic printing method form a desired image on recording material.

Image forming apparatuses which employ the electrophotographic printing method use, as a developer for developing a toner image, either: a one component developer which consists of a toner alone; or a two component developer which consists of a toner and a carrier. The inclusion of a carrier provides a two component developer the functions of stirring, carrying and charging toner particles. Since the toner contained in a two component developer does not need to have the functions of the carrier, the two component developer has the advantages of better controllability due to such separation of the functions and of allowing for a high quality image, in comparison with a one component developer, which is formed solely from toner particles. Accordingly, a lot of research and development has been conducted in connection with a toner suitable for use in combination with a carrier.

The carrier has two fundamental functions: the function of stably charging a toner to a desired level; and the function of carrying the toner to the photoreceptor. Further, the carrier is stirred in a developing tank and carried onto a magnet roller, on which the carrier forms a magnetic brush. Subsequently, the carrier passes through a regulating blade and then returns to the inside of the developing tank. This allows the carrier to be reused. The carrier is required, although reused, to stably realize the fundamental functions: in particular, the function of stably charging a toner. Some methods have been proposed for coating the surface of a carrier with a resin for the purpose of maintaining such a function of the carrier.

Such methods include, for instance, one for coating the surface of a carrier with a styrene-acrylic copolymer resin or a polyurethane resin, each of which has high, and another method for coating the surface of a carrier with a fluorine resin, which conversely has low surface tension. Although a resin having high surface tension has great adhesiveness to a carrier core, the resin has the problem of toner-spent. On the other hand, a fluorine resin having low surface tension has poor adhesiveness to a carrier core although being effective against the toner-spent problem. Therefore, when the carrier coated with such a fluorine having high surface tension is stirred in the developing tank, the resin coating separates from the carrier core. This inhibits stable charging.

For the purpose of solving the above problems, a carrier coated with a silicone resin has been proposed. However, a desired charge amount is unobtainable by solely providing a silicone resin coating. In light of this, Patent Document 1 (Japanese Unexamined Patent Application Publication No. 284862/1989 (Tokukaihei 1-284862; published on Nov. 16, 1989)), for example, discloses a method for adding a silicone coupling agent having an amino group to a resin.

Further, Patent Document 2 (Japanese Unexamined Patent Application Publication No. 29859/1989 (Tokukaishou 64-29859; published on Jan. 31, 1989)), for example, discloses a carrier whose surface is mechanically coated with a charge control agent so that the toner is stably charged.

Still further, Patent Document 3 (Japanese Unexamined Patent Application Publication No. 204666/1992 (Tokukaihei 4-204666; published on Jul. 27, 1992)), for example, discloses a developer which includes a carrier whose coating includes: a particular toner external additive; and quaternary ammonium salt as a charge control agent. The carrier described in Patent Document 3 is treated with toner external additives, i.e. a positively charged silicone coupling agent and a negatively charged silicone coupling agent. In addition, the carrier includes in the coating thereof quaternary ammonium salt. According to Patent Document 3, the use of such a carrier can suppress variations in charging of the toner which variations are caused by the environmental conditions.

Patent Document 4 (Japanese Unexamined Patent Application Publication No. 11864/1987 (Tokukaishou 62-11864; published on Jan. 20, 1987)), for example, discloses a developer including a carrier coated with a resin which contains a charge control agent of the same polarity as the polarity of the toner. According to Patent Document 4, any resin may be used for the coating of the carrier, and the inclusion of a charge control agent in the resin is characteristic.

Further, Patent Document 5 (Japanese Examined Patent Publication No. 49982/1993 (Tokukouhei 5-49982; published on Jul. 27, 1993)), for example, discloses a developer which includes a carrier coated with a positively or negatively charged synthetic resin, polarity of which is the same as the polarity of the toner.

SUMMARY OF THE INVENTION

With the advancement of full-color electrophotography in recent years, the improvements to toner have been grown. Improvement to toner external additives is part of the progress. The toner external additive has the function of providing fluidity for the toner and the function of assisting control for the charge amount of the toner. In color electrophotography, a toner external additive whose particle size is large tends to be added for the purpose of improving toner transfer efficiency. However, increase in the proportion of an external additive having a large particle size which additive is present on the surface inhibits the contact between the toner and the carrier. This makes it difficult to charge the toner stably. Further, as compared with a monochrome toner, a color toner has higher insulation due to its material, which makes it difficult to stabilize the charging.

The method disclosed in Patent Document 1 is effective against such problems when the primary particle size of an external additive (for instance, hydrophobized silica particles) with which the surface of a toner is coated is small, or specifically, not greater than 50 nm. The method is, however, not fully effective for a toner, such as a color toner, to which a large particle used for improving transfer efficiency is added.

The carrier described in Patent Document 2 exerts the effect of stabilizing charging of a toner while the charge control agent is present on the surface of a carrier. However, the charge control agent on the surface of a carrier becomes dispersively lost over time; therefore, the properties of the carrier becomes lost. Further, the developer described in Patent Document 3 is recognized to be effective against variations in the environmental conditions surrounding the carrier; however, a large amount of the toner external additive is spent to a carrier. Therefore, either the positively or negatively charged external additive tends to adhere to the surface of the carrier. This raises concern over the continuity of the effect in long-term use.

Further, the carrier included in the developer of Patent Document 4 is effective, as disclosed in an embodiment thereof, in cases where the toner to be charged includes a conductive substance such as a carbon black. However, in cases of using a toner which has high insulation such as a color toner, the continuity of the effect is unachievable. The reason for this is presumably that the resistance value of the entire carriers is uncontrollable in cases where the resin layer, i.e. the coating of the carrier, solely includes a charge control agent. This makes it difficult to charge a highly insulating color toner. Further, the use of a color toner for forming a multilayer image tends to increase the amount of an external additive in comparison with the use of a black toner, for the purpose of improving the transferring property of each color toner. Consequently, the external additive is more likely to adhere to the surface of the carrier. This presumably inhibits the toner from being charged through contact with the carrier, and thereby decreases the charge amount. Furthermore, the coating of the carrier described in Patent Document 5 is formed from a synthetic resin, as described above. Hence, it is assumed that in cases of using a color toner the effect is unachievable due to the high resistivity of the carrier.

The present invention has been accomplished in view of the above problems. It is an object of the present invention to realize a carrier, a developer, a development device, an image forming apparatus and an image forming method, each of which enables: stable charging of a toner which includes at least a binder resin and an organic colorant; and formation of a stable, high-resolution, high-quality image which has very few image defects such as a photographic fog.

With the aim of solving the above problems, the carrier of the present invention is used in a developer, the developer including the carrier and a toner which includes at least a binder resin and an organic colorant, wherein the carrier has a core and a coating formed on a surface of the core, the coating including (i) a charge control agent for controlling a charge whose polarity is a same as a polarity of a charge controlled by a charge control agent included in the toner, and (ii) conductive particles.

According to the above arrangement, a carrier which is capable of facilitating stable charging of a toner irrespective of the number of sheets printed can be realized since the coating on the surface of the carrier core includes: a charge control agent of the same polarity as the polarity of the charge control agent contained in the toner; and conductive particles. Accordingly, the use of a developer which includes the carrier of the above arrangement results in stable formation of a high-quality image which has high-resolution image reproduction, favorable color reproduction, high image density and very few image defects such as a photographic fog. The following is a conceivable reason for the ability to stabilize the charge amount. The use of conductive particles in the coating on the surface of the carrier core provides electric conductivity for a highly insulating toner such as a color toner. This improves electric conductivity of the toner. This charging is effective in early stages. However, the charge becomes depleted when the number of sheets printed increases, i.e. as the toner on the surface of a carrier is replaced with another. In view of this, the combination use, in the coating on the surface of the carrier core, of (i) the conductive particles and (ii) a charge generating substance such as a charge control agent having the same polarity as the polarity of the charge control agent contained in the toner enables a charge supply from the coating to the toner via the electrically conductive substance.

Additional objects, features, and strengths of the present invention will be made clear by the description below. Further, the advantages of the present invention will be evident from the following explanation in reference to the drawings.

DESCRIPTION OF THE EMBODIMENTS

Figure 1:
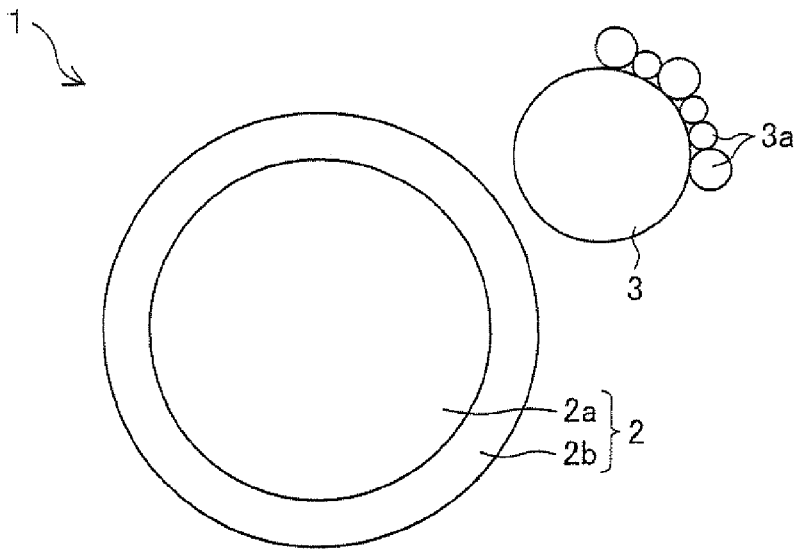
FIG. 1 is a diagram schematically showing a toner and a carrier both contained in a developer, according to an embodiment of the present invention.
Figure 2:
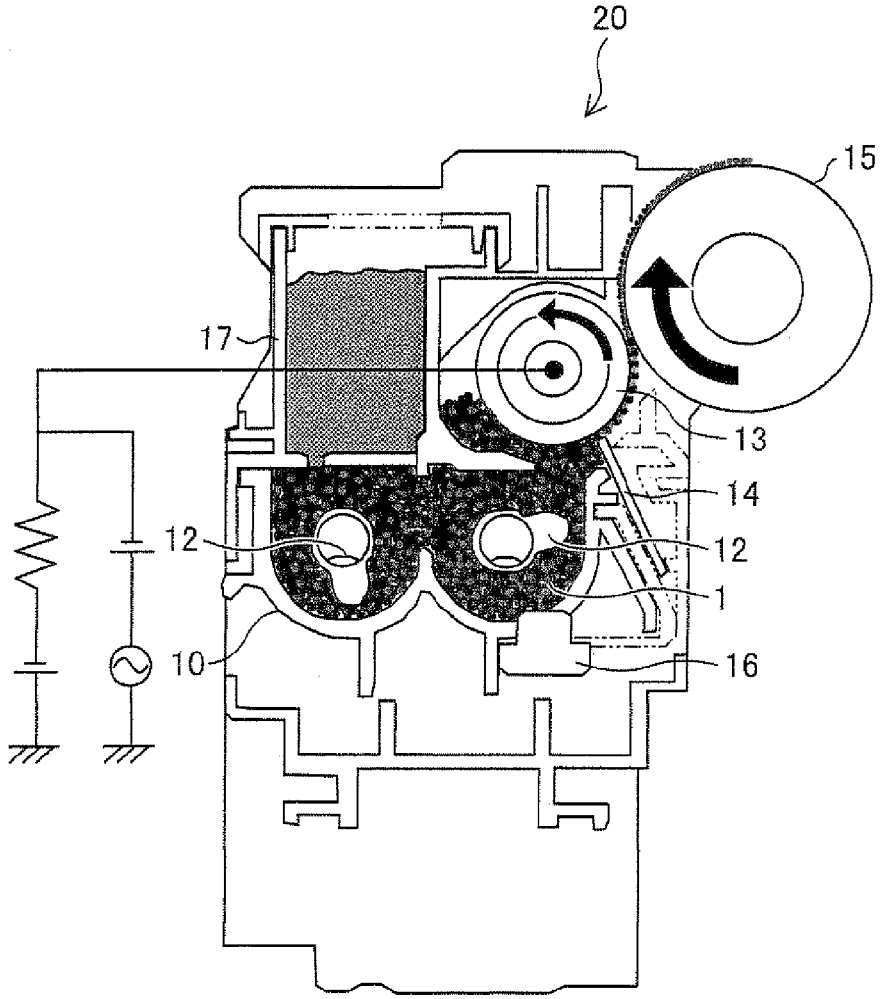
FIG. 2 is a schematic view showing a development device of the embodiment of the present invention.

The following explains an embodiment of the present invention with reference to FIGS. 1 and 2.

A developer 1 of the present embodiment is a two component developer which includes a toner 3 and a carrier 2. The toner, the carrier and the developer will be described in this successive order. It should be noted that the words "toner" and "carrier" hereinafter refer to the entire toner and the entire carrier respectively unless followed by the word "particle".

[Toner]

Two or more kinds of external additives having different particle sizes are added to the toner 3 with the particles attached to the surface of the toner 3. The materials for the toner 3 include a binder resin and a colorant as essential components, and also includes a charge control agent, a release agent and the like.

The binder resin of the present embodiment is not particularly limited, and therefore any known binder resin for use in a black toner or a color toner can be used. Examples of the binder resin include (i) a polyester resin, (ii) a styrene resin such as a polystyrene and a styrene-acrylic acid ester copolymer resin, (iii) an acrylic resin such as a polymethylmethacrylate, (iv) a polyolefin resin such as a polyethylene, (v) a polyurethane, and (vi) an epoxy resin. Further, the binder resin may be a resin obtained by polymerization reaction induced by mixture of a monomer mixture material and a release agent. These binder resins may be used either alone respectively or in combinations of two or more kinds.

In a case of using a polyester resin as the binder resin, aromatic alcohol components which can be used to acquire a polyester resin include, for instance, bisphenol-A, polyoxyethylene-(2.2)-2,2-bis(4-hydroxyphenyl)propane, polyoxyethylene-(2.0)-2,2-bis(4-hydroxyphenyl)propane, polyoxypropylene-(2.0)-2,2-bis(4-hydroxyphenyl) propane, polyoxypropylene-(2.2)-polyoxyethylene-(2.0)-2,2-bis(4-hydroxyphenyl)propane, polyoxypropylene-(6)-2,2-bis(4-hydroxyphenyl)propane, polyoxypropylene-(2.2)-2,2-bis(4-hydroxyphenyl)propane, polyoxypropylene-(2.4)-2,2-bis(4-hydroxyphenyl)propane, polyoxypropylene-(3.3)-2,2-bis(4-hydroxyphenyl)propane or a derivative of any of these substances.

A polybasic acid component of the above polyester resin can be (i) a dibasic acid such as a succinic acid, an adipic acid, a sebacic acid, an azelaic acid, a dodecenyl succinic acid, an n-dodecyl succinic acid, a malonic acid, a maleic acid, a fumaric acid, a citraconic acid, an itaconic acid, a glutaconic acid, a cyclohexanedicarboxylic acid, an orthophthalic acid, an isophthalic acid and a terephthalic acid, (ii) a tribasic acid or an acid having four or more bases, such as a trimellitic acid, a trimethine acid and a pyromellitic acid, (iii) an anhydride of any one of these substances or (iv) a lower alkyl ester of any one of these substances. Among these substances, a terephthalic acid or a lower alkyl ester thereof is preferable in terms of heat resistance and cohesiveness.

The acid value of the polyester resin, a component of the toner, preferably falls in the range of 5 mgKOH/g to 30 mgKOH/g. The acid value of less than 5 mgKOH/g causes the charging property of the resin to decrease and makes the charge control agent less likely to disperse in the polyester resin. This negatively affects the rise time of charging, i.e. the time that elapses before the charge amount reaches a predetermined amount at the rise of charging and/or stability of the charge amount at the time of repeated developments in continuous use. The above range is preferable, accordingly.

Regarding a colorant, various colorants are usable in accordance with a desired color; for instance, a yellow toner colorant, a magenta toner colorant, a cyan toner colorant and a black toner colorant.

Regarding a yellow toner colorant, usable colorants include, in reference to the color index classification, (i) an azo pigment such as C.I. Pigment Yellow 1, C.I. Pigment Yellow 5, C.I. Pigment Yellow 12, C.I. Pigment Yellow 15 and C.I. Pigment Yellow 17, (ii) an inorganic pigment such as a yellow iron oxide and an ocher, (iii) a nitro dye such as C.I. Acid Yellow 1, and (iv) an oil soluble dye such as C.I. Solvent Yellow 2, C.I. Solvent Yellow 6, C.I. Solvent Yellow 14, C.I. Solvent Yellow 15, C.I. Solvent Yellow 19 and C.I. Solvent Yellow 21, for example.

Regarding a magenta toner colorant, usable colorants include, in reference to the color index classification, C.I. Pigment Red 49, C.I. Pigment Red 57, C.I. Pigment Red 81, C.I. Pigment Red 122, C.I. Solvent Red 19, C.I. Solvent Red 49, C.I. Solvent Red 52, C.I. Basic Red to and C.I. Disperse Red 15, for example.

Regarding a cyan toner colorant, usable colorants include, in reference to the color index classification, C.I. Pigment Blue 15, C.I. Pigment Blue 16, C.I. Solvent Blue 55, C.I. Solvent Blue 70, C.I. Direct Blue 25, and C.I. Direct Blue 86, for example.

Regarding a black toner colorant, usable colorants include a carbon black such as a channel black, a roller black, a disc black, a gas furnace black, an oil furnace black, a thermal black and an acetylene black, for example. Proper selection of a carbon black can be made from among the above in accordance with the design property of a toner to be acquired.

In addition to the above pigments, a crimson pigment, a green pigment and other pigments can also be used as a colorant. These colorants may be used either alone respectively or in combinations of two or more kinds. Further, two or more colorants of similar colors can be used, and two or more colorants of different colors can also be used.

Furthermore, use of a masterbatched colorant may be made. A masterbatched colorant can be prepared in the same manner as a general masterbatch. For instance, a fused synthetic resin and a colorant are kneaded so that the colorant is uniformly dispersed in the synthetic resin. Subsequently, the resultant mixture is granulated to form a masterbatch. Usable synthetic resin is a synthetic resin of the same kind as the binder resin of the toner, or a synthetic resin having favorable compatibility with the binder resin of the toner. Although the ratio of the colorant to the synthetic resin is not particularly limited, it is preferably 30 to 100 parts by weight in relation to 100 parts by weight of the synthetic resin. Further, the masterbatch has a particle size in the order of 2 mm to 3 mm.

Although the amount of a colorant to be used is not particularly limited, it is preferably 5 to 20 parts by weight in relation to 100 parts by weight of the binder resin. This amount does not refer to the amount of the masterbatch; it refers to the amount of the colorant itself contained in the masterbatch. The use of a colorant in conformity with the above range prevents various physical properties of the toner from being damaged, and thereby enables an extremely high-quality, high-density image to be formed.

The purpose of adding the charge control agent to the toner is to control a triboelectric charging property of the toner 3. Usable charge control agents include a charge control agent, commonly used in the art for controlling a positive charge or a negative charge. Charge control agents for controlling a positive charge that can be used include, for example, a nigrosine dye, a basic dye, a quaternary ammonium salt, a quaternary phosphonium salt, an aminopyrine, a pyrimidine compound, a polynuclear polyamino compound, an aminosilane, a nigrosine dye, a derivative thereof, a triphenylmethane derivative, a guanidine salt and an amidin salt. Charge control agents for controlling a negative charge that can be used include, for example, an oil-soluble dye such as an oil black and a spirone black, a metal-containing azo compound, an azo complex dye, a naphthene acid metal salt, a metal complex or metal salt (where the metal is a chrome, a zinc, a zirconium or the like) of a salicylic acid or of a derivative thereof, a boron compound, a fatty acid soap, a long-chain alkylcarboxylic acid salt and a resin acid soap. Among these substances, a boron compound, which is devoid of heavy metal, is particularly preferable. Either a charge control agent for controlling a positive charge or a charge control agent for controlling a positive charge can be selected according to individual purposes. These charge control agents may be used either alone respectively or in combinations of two or more kinds. While use of a single charge control agent can be made, combinational use of two or more charge control agents can also be made when necessary. Although the amount of a charge control agent to be used is not particularly limited and can be properly selected from a wide range, it is preferably 0.5 to 3 parts by weight in relation to 100 parts by weight of the binder resin.

The release agent can be the one commonly used in the art; for example, (i) a petroleum wax such as a paraffin wax, a derivative thereof, a microcrystalline wax and a derivative thereof, (ii) a hydrocarbon synthetic wax such as a Fischer-Tropsch wax, a derivative thereof, a polyolefin wax, a derivative thereof, a low-molecular-weight polypropylene wax, a derivative thereof, a polyolefin polymer wax (e.g. a low-molecular-weight polyethylene wax) and a derivative thereof, (iii) a botanical wax such as a carnauba wax, a derivative thereof, a rice wax, a derivative thereof, a candelilla wax, a derivative thereof and a Japan wax, (iv) an animal wax such as a beeswax and a spermaceti wax, (v) a synthetic wax of fat and oil such as a fatty acid amide and a phenol fatty acid ester, a long-chain monocarboxylic acid, a derivative thereof, a long-chain alcohol, a derivative thereof, a silicone polymer and a higher fatty acid. Additionally, examples of the above derivatives include an oxide, a vinyl monomer-wax block copolymer, and a vinyl monomer-wax graft denatured material. Although the amount of the release agent to be used is not particularly limited and can be properly selected from a wide range, it is preferably 0.2 to 20 parts by weight in relation to 100 parts by weight of the binder resin.

The external additive 3*a* of the toner 3 can be the one commonly used in the art; for example, a silicon oxide, a titanic oxide, a silicon carbide, an aluminum oxide and a barium titanate. According to the present embodiment, two or more kinds of external additives having different particle sizes are used in combination, and at least one of the kinds has a primary particle size of not less than 0.1 μm and not more than 0.2 μm. The use of the external additives at least one of which has a primary particle size of not less than 0.1 μm allows for improvement in transfer property and long-term and stable charging of the toner 3 without poor charging caused by adhesion of the external additive to the surface of the carrier, particularly with respect to a color toner. Although the amount of external additives to be used is not particularly limited, it is preferably 0.1 to 3.0 parts by weight in relation to 100 parts by weight of the toner 3.

The above materials for the toner 3, except for an external additive, are mixed by a mixer such as a Henschel mixer, a super mixer, a mechano mill or a Q-type mixer. The material mixture thus acquired is fused and kneaded by a kneader such as a biaxial kneader, a uniaxial kneader or a continuous double-roll kneader, at a temperature in the order of 70° C. to 180° C. The material mixture is thereafter cooled and solidified. After the material mixture for the toner 3 that has been fused and kneaded is cooled and solidified, the material mixture is coarsely ground by a cutter mill, a feather mill or the like. The material mixture thus ground coarsely is ground finely by means of a jet mill, a fluidized-bed type jet mill or the like. The above grinders perform grinding of toner particles by causing air currents which include the toner particles to collide with one another in a plurality of directions, thereby causing the toner particles to collide with one another. As a result, the toner 3, which is nonmagnetic and has a particular particle size distribution, is prepared. Although the particle size of the toner 3 is not particularly limited, the average particle size is preferably in the range of 3 μm to 10 μm. Further, particle size control such as classification may be performed when necessary. To the toner 3 thus prepared, the external additive 3*a* is added by a known method. Note that the preparation method of the toner 3 is not limited to the above.

[Carrier]

As illustrated in FIG. 1, the carrier 2 of the present embodiment has a structure in which a carrier core 2*a* is coated with a coating 2*b*. The coating 2*b* is formed from a resin composition for coating which resin composition includes: a charge control agent having the same polarity as the polarity of a charge control agent contained in the toner 3; and conductive particles. This enables the carrier 2 to charge the toner 3 sufficiently.

The carrier core 2*a* can be formed from such a material commonly used in the art as (i) a magnetic metal including an iron, a copper, a nickel and a cobalt, and (ii) a magnetic metal oxide including a ferrite and a magnetite. Among these substances, a ferrite is preferable since a ferrite exhibits great charging performance, excellent durability and proper saturation magnetization. The use of the carrier core 2*a* formed from a magnetic substance as above allows a carrier to be suitable for a developer which is used in the magnetic brush development method. The carrier core 2*a* preferably has a volume average particle size in the range of 25 μm to 100 μm, particularly preferably 25 μm to 90 μm. According to the present embodiment, the volume average particle size is measured by means of particle size measuring apparatus Micro Trac (product name: Micro Trac MT3000, manufactured by Nikkiso Co., Ltd.).

The resin composition for coating, which forms the coating 2*b* on the surface of the carrier core 2*a* is a resin containing: a charge control agent having the same polarity as the polarity of a charge control agent contained in the toner; and conductive particles.

The resin of the resin composition for coating is not particularly limited, and can be any known resin. However, the use of a resin including at least either a silicone resin or a denatured resin thereof results in a more favorable result, since the resin composition including such a resin realizes both a releasing property with respect to the toner 3 and adhesiveness to the carrier core 2*a*.

The silicone resin and the denatured resin thereof of the present embodiment are not particularly limited, and can be any silicone resin and any denatured resin thereof commonly used in the art. In particular, a crosslinkable silicone resin and a denatured resin thereof are preferable. A crosslinkable silicone resin is a known silicone resin which is formed as the chemical formulae below show. That is, (i) hydroxyl groups each bonding with a Si atom or (ii) a hydroxyl group and an —OX group each bonding with a Si atom are cross-linked and cured by thermal dehydration reaction, room temperature curing reaction or the like reaction.

[Thermal Dehydration Reaction]

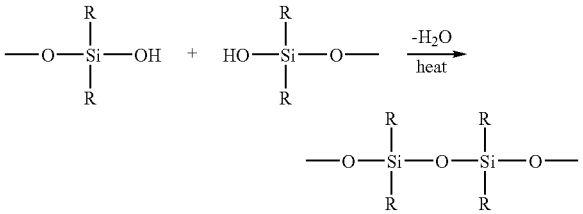

[Room Temperature Curing Reaction]

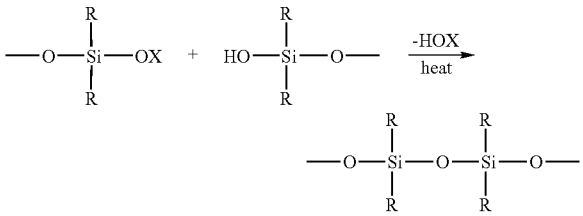

(In the formulae, the plurality of Rs represent identical or different monovalent organic groups. The —OX group represents an acetoxy group, an aminoxy group, an alkoxy group, an oxime group or the like.)

The crosslinkable silicone resin may be either a silicone resin of thermal curing type or a silicone resin of room temperature curing type. The silicone resin of the thermal curing type needs heating at a temperature in the order of 200° C. to 250° C. so as to be cross-linked. Although the silicone resin of room temperature curing type does not need heating to be cured, it is preferable to heat the resin at a temperature in the order of 150° C. to 280° C. so that the time for curing the resin is shortened.

The crosslinkable silicone resin is preferably formed such that the monovalent organic group represented by R is a methyl group. A crosslinkable silicone resin whose R is a methyl group has a close cross-linked structure. Thus, formation of the coating 2*b* by use of such a crosslinkable silicone resin enables preparation of the carrier 2 which has favorable water repellency and moisture resistance. It should be noted that an overly close cross-linked structure tends to cause the coating 2*b* to become fragile; therefore, careful selection of the molecular weight of the crosslinkable silicone resin is important.

Further, the weight ratio (Si/C) of the silicon to the carbon contained in the crosslinkable silicone resin is preferably in the range of 0.3 to 2.2. The Si/C ratio of less than 0.3 decreases the hardness of the coating 2*b* and may therefore shorten the life of the carrier 2. On the other hand, the Si/C ratio of greater than 2.2 makes the charge donating property of the carrier 2 with respect to the toner 3 more likely to be subject to variations in temperature, and may therefore cause the coating 2*b* to become fragile.

A crosslinkable silicone resin commercially available can be used for the resin composition for coating; for instance, SR2400, SR2410, SR2411, SR2510, SK2405, 840RESIN, 804RESIN (all of which are the names of products manufactured by Dow Corning Toray Co., Ltd.), KR271, KR272, KR274, KR216, KR280, KR282, KR261, KR260, KR255, KR266, KR251, KR155, KR152, KR214, KR220, X-4040-171, KR201, KR5202, KR3093 (all of which are the names of products manufactured by Shin-Etsu Chemical Co., Ltd.) and the like. These crosslinkable silicone resins may be used either alone respectively or in combinations of two or more kinds Alternatively, a denatured silicone resin such as an acrylic resin and an epoxy resin can be used for the resin composition for coating. This improves the adhesiveness of the coating 2*b* to the carrier core 2*a*.

According to the present embodiment, a charge control agent having the same polarity as the polarity of the charge control agent contained in the toner 3 is used in the resin composition for coating. Thus, a charge control agent for controlling either a positive charge or a negative charge can be used in conformity to the charge control agent contained in the toner 3. Charge control agents for controlling a positive charge that can be used for the resin composition include, for example, a nigrosine dye, a basic dye, a quaternary ammonium salt, a quaternary phosphonium salt, an aminopyrine, a pyrimidine compound, a polynuclear polyamino compound, an aminosilane, a nigrosine dye and a derivative thereof, a triphenylmethane derivative, a guanidine salt and an amidin salt. Charge control agents for controlling a negative charge that can be used for the resin composition include an oil-soluble dye such as an oil black and a spirone black, a metal-containing azo compound, an azo complex dye, a naphthene acid metal salt, a metal complex compound or metal salt (the metal is a chrome, a zinc, a zirconium or the like) of a salicylic acid or a derivative thereof, a boron compound, a fatty acid soap, a long-chain alkylcarboxylic acid salt and a resin acid soap. Among the above, a boron compound, which is devoid of heavy metal, is particularly preferable. These charge control agents may be used either alone respectively or in combinations of two or more kinds when necessary. Although the amount of the charge control agent to be used is not particularly limited and can be properly selected from a wide range, it is preferably 0.1 to 20 parts by weight in relation to 100 parts by weight of the resin contained in the resin composition for coating.

The conductive particles of the present embodiment can be a conductive carbon black or an oxide such as a conductive titanic oxide or a tin oxide, for instance. For the purpose of providing electric conductivity to the coating 2*b* by addition of conductive particles in small amount, a carbon black or the like is preferably applicable. However, when the coating 2*b* including such conductive particles is used in combination with a color toner, separation of carbon from the coating 2*b* of the carrier 2 may be a concern. In this case, a conductive titanic oxide which is doped with antimony or the like is used.

Further, a silane coupling agent may be included in the carrier 2 so that the amount of charging to the toner is controlled. More specifically, use of a silane coupling agent which includes a functional group having an electron-donating property is preferable. A specific example of a silane coupling agent is an amino-group-containing silane coupling agent. Any known amino-group-containing silane coupling agent can be used in the present embodiment; for example, the amino-group-containing silane coupling agent represented by general formula (I):

$$(Y)n\mathrm{Si}(R)m \qquad (1)$$

(In the formula, m-number of Rs represent identical or different alkyl groups, alkoxy groups or chlorine atoms, while n-number of Ys represent identical or different hydrocarbon groups containing an amino group. Each of m and n represents an integer of 1 to 3, where m+n=4.)

In the above general formula (I), the alkyl group represented by R can be, for instance, a straight-chain or branched-chain alkyl group having 1 to 4 carbon atoms such as a methyl group, an ethyl group, a propyl group, an isopropyl group, a butyl group, an isobutyl group and a tert-butyl group. Among the above, a methyl group and an ethyl group are preferable. The alkoxy group can be, for instance, a straight-chain or branched-chain alkoxy group having 1 to 4 carbons such as a methoxy group, an ethoxy group, a propoxy group, an isopropoxy group, a butoxy group, an isobutoxy group and a tert-butoxy group. Among the above, a methoxy group and an ethoxy group are preferable. The hydrocarbon group containing an amino group represented by Y can be, for instance, —$(CH_2)$a-X (where X represents an amino group, an aminocarbonyl amino group, an aminoalkyl amino group, a phenylamino group or a dialkylamino group, and a represents an integer of 1 to 4), -Ph-X (where X represents the same as above, and -Ph- represents a phenylene group) and the like.

The following are some specific examples of the amino-group-containing silane coupling agent.

$H_2N(H_2C)_3Si(OCH_3)_3$ $H_2N(H_2C)_3Si(OC_2H_5)_3$ $H_2N(H_2C)_3Si(CH_3)(OCH_3)_2$ $H_2N(H_2C)_2HN(H_2C)_3Si(CH_3)(OCH_3)_2$ $H_2NOCHN(H_2C)_3Si(OC_2H_5)_3$ $H_2N(H_2C)_2HN(H_2C)_3Si(OCH_3)_3$ $H_2N$-Ph-$Si(OCH_3)_3$ (where -Ph- represents a p-phenylene group)

Ph-$HN(H_2C)_3Si(OCH_3)_3$ (where Ph- represents a phenyl group)

$(H_9C_4)_2N(H_2C)_3Si(OCH_3)_3$

These amino-group-containing silane coupling agents may be used either alone respectively or in combinations of two or more kinds. The amount of the amino-group-containing silane coupling agent to be used is properly selected from a certain range such that the toner 3 is charged sufficiently, and that the mechanical strength of the coating 2*b* is not significantly reduced. The amount of the amino-group-containing silane coupling agent is preferably not more than 10 parts by weight, or more preferably 0.01 to 10 parts by weight in relation to 100 parts by weight of the resin contained in the resin composition for coating.

The resin composition for coating can include another resin as well as the silicone resin on condition that a favorable property of the resin coating, which is formed from a silicone resin (in particular, a crosslinkable silicone resin) and/or a denatured resin thereof, is undamaged. Such another resin includes, for instance, an epoxy resin, a urethane resin, a phenol resin, an acrylic resin, a styrene resin, a polyamide, a polyester, an acetal resin, a polycarbonate, a vinyl chloride resin, a vinyl acetate resin, a cellulosic resin, a polyolefin, a copolymer resin of these substances and a compounded resin of these substances.

The resin composition for coating may include a bifunctional silicone oil so that the moisture resistance, the releasing property and other properties of the resin coating, which coating is formed from a silicone resin (in particular, a crosslinkable silicone resin) and/or a denatured resin thereof, are further improved.

The resin composition for coating can be made by mixing predetermined amounts of a silicone resin and/or a denatured resin thereof and a amino-group-containing silane coupling agent, in combination, and optionally a resin other than the silicone resin and a proper amount of additive agent such as bifunctional silicone oil. One form of the resin composition for coating is a solution which results from dissolving the above components in an organic solvent. The organic solvent may be any solvent as long as it is capable of dissolving a silicone resin. Examples of the organic solvent include an aromatic hydrocarbon such as a toluene and a xylene, a ketone such as an acetone and a methyl ethyl ketone, an ether such as a tetrahydrofuran and a dioxane, a higher alcohol and a mixed solvent of two or more of these substances. The use of the resin composition for coating in the form of a solution (hereinafter referred to as "coat resin solution") facilitates formation of the coating 2*b* on the surface of the carrier core 2*a*. For example, the coat resin solution is applied on the surface of the carrier core 2*a* so that an applied layer is formed, and the organic solvent in the applied layer is then volatilized on heating. Subsequently, the applied layer is cured thermally or at room temperature in the process of dehydration or after dehydration. As a result, the coating 2*b* is formed, and the carrier 2 is thereby prepared.

The methods for applying the coat resin solution to the surface of the carrier core 2*a* include, for instance, (i) a dipping process in which the carrier core 2*a* is impregnated in the coat resin solution, (ii) a spray process in which the carrier core 2*a* is sprayed with the coat resin solution, and (iii) a fluid-bed process in which the carrier core 2*a* which is in suspension due to a fluidized air current is sprayed with the coat resin solution. Among these processes, the dipping process is preferable since it facilitates the formation of a film.

The applied layer can be dehydrated by means of a drying accelerator. A known drying accelerator can be used for the above purpose; for instance, (i) a metallic soap of iron, cobalt, manganese, zinc salt or the like containing naphthyl acid, octylic acid or the like, and (ii) an organic amine such as ethanolamine. These drying accelerators may be used either alone respectively or in combination of two or more kinds.

The applied layer is cured by heating at a temperature selected depending on the kind of the silicone resin; for instance, preferably at a temperature in the order of 150° C. to 280° C. Although a silicone resin of the room temperature curing type evidently does not need to be heated, heating of such a silicone resin may be performed at a temperature in the order of 150° C. to 280° C. for such purposes as improving the mechanical strength of the resin coating and shortening the time for curing.

The total solid concentration of the coat resin solution is not particularly limited. In consideration of the process of applying the coat resin solution to the carrier core 2*a*, the thickness of the coating 2*b* after cured can be adjusted so as to be not greater than 5 μm, or preferably in the order of 0.1 μm to 3 μm.

The carrier 2 thus acquired is preferably high in electric resistance and spherical in shape. However, even if the carrier 2 is electrically conductive or non-spherical, the effect of the present invention is not lost.

[Developer]

The developer 1 is prepared by mixing the toner 3 and the carrier 2. The mixing ratio of the toner 3 to the carrier 2 is not particularly limited. However, in consideration of use of the developer in a high-speed image forming apparatus (which is capable of processing 40 or more A4-size sheets per minute), the ratio (the total projection area of the toner/the total surface area of the carrier×100) of (i) the total projection area of the toner 3 (i.e. the sum of the projection areas of all the toner particles) to (ii) the total surface area of the carrier (i.e. the sum of the surface areas of all the carrier particles) is in the range of 30% to 70%, when the volume average particle size of the carrier/the volume average particle size of the toner is not less than 5. The developer thus prepared is preferably capable of: stably maintaining a sufficiently favorable charging property of the toner; and therefore stably and continuously forming a high-quality image in a high-speed image forming apparatus. In the case, for instance, where: the volume average particle size of the toner is 6.5 μm; the volume average particle size of the carrier is 90 μm; and the ratio of the total projection area of the toner to the total surface area of the carrier is 30% to 70%, the developer 1 contains 2.2 to 5.3 parts by weight of the toner in relation to 100 parts by weight of the carrier. The use of such a developer 1 in high-speed development maximizes both the amount of toner consumption and the toner amount that is supplied to the developing tank of a development device in response to toner consumption, while the supply-demand balance of the toner is maintained. When the amount of the carrier 2 contained in the developer 1 exceeds the range of 2.2 to 5.3 parts by weight, the charge amount tends to be small, whereby a desired developing property is unobtainable. In addition, the toner consumption exceeds the toner supply, and the toner 3 cannot be charged sufficiently. This in turn decreases image quality. Conversely, when the amount of the carrier 2 is small, the charge amount tends to be large, whereby the toner 3 is less likely to separate from the carrier 2 due to an electric field generated. This eventually decreases image quality.

According to the present embodiment, the total projection area of the toner is calculated as follows. When the specific gravity of the toner is set to 1.0, the total projection area is calculated based on a volume average particle size acquired by a Coulter Counter (product name: Coulter Counter Multisizer II, manufactured by Beckman Coulter, Inc.). Specifically, the number of toner particles corresponding to the weight of the toner to be mixed is calculated, and subsequently the number of the toner particles is multiplied by the toner area (calculated on the supposition that the area is circular), to return the total projection area of the toner. Similarly, the total surface area of the carrier is calculated with use of the weight of the carrier to be mixed, based on a particle size acquired by a Micro Trac (product name: Micro Trac MT3000, manufactured by Nikkiso Co., Ltd.). In the foregoing calculation, the specific gravity of the carrier is set to 4.7. The mixing ratio is calculated by multiplying by 100 the total projection area of the toner/the total surface area of the carrier, both of which are obtained as above.

[The Development Device and the Image Forming Apparatus]

A development device 20 of the present embodiment performs development with use of the developer 1 of the present embodiment. The development device 20 includes, as illustrated in FIG. 2, a development unit 10 which stores the developer 1, and a developer bearing member (a developer carrying/bearing member) 13 which carries the developer 1 to an image bearing member (image forming body; photoreceptor) 15.

The developer (two component developer) 1 of the present embodiment, which is formed by the carrier 2 and the toner 3 of the present embodiment and supplied in advance to the development unit 10, is stirred and thereby charged by stirring screws 12. Subsequently, the developer 1 is carried by the developer bearing member 13, in which magnetic field generating means is provided, and thereby held on the surface of the developer bearing member 13. The developer 1 which is held on the surface of the developer bearing member 13 is regulated to be at a constant thickness by a developer regulating member 14. The developer 1 is then carried to an image forming region in which the developer bearing member 13 and the image bearing member 15 are close to each other. An electrostatic image on the image bearing member 15 is thereafter caused to be visible by reversal development in an oscillating electric field which is formed by applying an alternating bias voltage to the developer bearing member 13.

The toner consumption resulting from formation of a visible image is detected by a toner density sensor 16, which, for the above purpose, senses variations in the toner density, i.e., a weight ratio of the toner to the developer. The toner consumed is compensated for by a toner supply from a toner hopper 17 to the extent that the toner density sensor 16 detects that the toner density has reached a predetermined level. As a result, the toner density of the developer 1 contained in the development unit 10 is maintained substantially at a constant level. Furthermore, according to the present embodiment, the gap between the developer bearing member 13 and the developer regulating member 14 and the gap between the developer bearing member 13 and the image bearing member 15 may be 0.4 mm, for example. However, this is merely an example, and therefore, the gaps are not limited to the above value.

An image forming apparatus of the present embodiment is equipped with the development device 20. Regarding other components of the image forming apparatus, those of a known electrophotographic image forming apparatus are applicable; for instance, (i) an image bearing member which includes a photosensitive layer on the surface of which an electrostatic image can be formed, (ii) charging means for charging the surface of the image bearing member so that the surface thereof has a predetermined potential, (iii) exposure means for forming an electrostatic image (electrostatic latent image) on the surface of the image bearing member by projecting signal light corresponding to image information onto the image bearing member whose surface is being charged, (iv) transfer means for transferring a toner image formed on the surface of the image bearing member which toner image is developed when the toner 3 is supplied from the development device 20, onto an intermediate transfer member, and then onto recording material, (v) fixing means for fixing on the recording material the toner image transferred onto the surface of the recording material, (vi) cleaning means for removing toner and paper dust which remain on the surface of the image bearing member after the toner image is transferred onto the recording material, and (vii) another cleaning means for removing redundant toner which adheres to the intermediate transfer member. Further, an image forming method of the present embodiment is realized by use of the image forming apparatus of the present embodiment, which image forming apparatus includes the development device 20 of the present embodiment.

In developing an electrostatic image, a development step is performed for each toner color, which step allows the electrostatic image on the image bearing member to be visible by reversal development. Laying a plurality of toner images having different colors on top of one another on the intermediate transfer member results in formation of a polychrome toner image. Although the present embodiment adopts the intermediate transfer method using an intermediate transfer member, a toner image may also be transferred from the image bearing member directly onto recording material.

The image forming apparatus of the present embodiment and the image forming method which uses the image forming apparatus are capable of stably and continuously forming a high-resolution, high-density, polychrome image which exhibits excellent image reproduction including color reproduction.

EXAMPLES

The following explains examples of the present invention and comparative examples. The present invention is not limited to the descriptions of the present examples, and can be applied in many applications, provided such variations do not exceed the scope of the present invention. In the examples and the comparative examples, measurements were carried out in connection with use of a developer which includes a toner and a carrier. First, the preparation methods of the carrier and the toner which were both contained in the developer used in the examples and the comparative examples will be explained. Hereinafter, the word "part" refers to "part by weight". Further, the symbol "%" refers to "% by weight" unless otherwise indicated.

[Preparation of the Carrier]

The following describes the preparation of 6 kinds of carriers (carriers (1) to (6)). First, a silicone resin, conductive particles and a toluene, each in such an amount (part) that is shown in Table 1 below, were stirred by a three-one motor for 5 minutes to prepare a coat resin solution. It should be noted that the conductive particles were used in the form of being in advance dispersed in a toluene solvent by means of a dispersing agent, and that the charge control agent was used in the form of being dissolved in a predetermined solvent. The coat resin solution was mixed by a stirring machine with ferrite cores (carrier cores) having the volume average particle sizes (μm) and the amounts (parts), both shown in Table 1 below. The resultant mixture was heated under reduced pressure so that the toluene was removed. This formed an applied layer on the surface of the ferrite cores. In this stage, the mixture was heated at 200° C. for one hour so that the applied layer was cured, whereby a coating was formed. The mixture was then sifted through a sieve having 100 meshes, so that the carriers (1) to (6) were prepared.

The silicone resin and the conductive particles shown in Table 1 are specifically the following.

Silicone Resin: A

Product name: SR2411, manufactured by Dow Corning Toray Co., Ltd.

(a solution having 20% silicone resin content)

Conductive Particle: B

Product name: VULCANXC72, manufactured by Cabot Corporation (a carbon black-toluene dispersing conductive solution having a 15% solid concentration)

Conductive Particle: C

Product name: FS-10P, manufactured by Ishihara Sangyo Kaisha, Ltd.

(a titanic oxide-toluene dispersing conductive solution having a 30% solid concentration)

Charge Control Agent: D

Product name: E-81, manufactured by Orient Chemical Industries, Ltd.

(a negative charge control agent having 5% acetone content)

Charge Control Agent: E

Product name: LR-147, manufactured by Japan Carlit Co., Ltd.

(a negative charge control agent having 5% toluene content)

Coupling Agent: F

Product name: SH6020, manufactured by Dow Corning Toray Co., Ltd.

(100% pure solution)

TABLE 1

| | ferrite core | | coat resin solvent | | | | | | | | |
|---|---|---|---|---|---|---|---|---|---|---|---|
| | volume average particle | | silicone resin | | conductive agent | | charge control agent | | coupling agent | | toluene |
| carrier | size | amount | kind | amount | kind | amount | kind | amount | kind | amount | amount |
| 1 | 35μ | 1000 parts | A | 115 parts | B | 6 parts | D | 23 parts | F | 3 parts | 20 parts |
| 2 | 45μ | 1000 parts | A | 100 parts | B | 6 parts | E | 20 parts | F | 4 parts | 15 parts |
| 3 | 90μ | 1000 parts | A | 50 parts | B | 3 parts | D | 10 parts | F | 2 parts | 20 parts |
| 4 | 55μ | 1000 parts | A | 75 parts | C | 15 parts | D | 15 parts | F | 3 parts | 20 parts |
| 5 | 45μ | 1000 parts | A | 100 parts | — | — | E | 20 parts | F | 4 parts | 15 parts |
| 6 | 45μ | 1000 parts | A | 100 parts | B | 6 parts | — | — | F | 4 parts | 15 parts |

A carrier (7) was prepared in the same manner as above with use of the same materials as the carrier (4), except that the conductive agent had 17.5 parts. In the preparation of the carrier (7), a large number of spots of the coat resin were adherent to the interior machine wall. Therefore, it was determined that the coat layer was uneven, and consequently, the carrier (7) was not used in the measurement described below.

[Preparation of the Toner]

The following describes the preparation of 4 kinds of toners (toners (1) to (4)).

Toner (1)

Polyester resin (acid value: 21 mgKOH/g, aromatic alcohol component: PO-BPA and EP-BPA, acid component: fumaric acid and anhydrous mellitic acid) . . . 87.5% by weight C.I. Pigment Blue 15:1 . . . 5% by weight Nonpolar paraffin wax (DSC peak at 78° C., Mw8.32×$10^2$) . . . 6% by weight (where Mw is a weight-average molecular weight)

Charge control agent (Bontron E-84, manufactured by Orient Chemical Industries, Ltd.) . . . 1.5% by weight The above constituent materials were premixed by a Henschel mixer, and then fused and kneaded by a biaxial extrusion kneader. After the mixture thus kneaded was coarsely ground by a cutter mill, the mixture was finely grounded by a jet mill. The mixture thus grounded was then classified by a wind power classification device, whereby a toner matrix particle having an average particle size of 6.5 μm was prepared. Subsequently, the toner matrix particle having 97.8% by weight, which was obtained as a result of the classification, was mixed by a Henschel mixer with (i) a silica having 1.2 parts by weight, which was hydrophobized by i-butyltrimethoxysilane having a volume average particle size of 0.1 μm, and (ii) a silica particle having 1.0 parts by weight, which was hydrophobized by HMDS having a volume particle size of 12 nm. Finally, addition of external additives to the mixture completed the preparation of the toner (1).

Toner (2)

The toner (2) was prepared in the same manner with use of the same materials as the toner (1), except the use of a carbon black in place of C.I. Pigment Blue 15:1.

Toner (3)

The toner (3) was prepared in the same manner with use of the same materials as the toner (1), except the use of LR-147 (manufactured by Japan Carlit Co., Ltd.) in place of the charge control agent E-81.

Toner (4)

The toner (4) was prepared in the same manner with use of the same materials as the toner (1), except the disuse of the hydrophobized silica having a volume average particle size of 100 nm.

The following describes the measurement of the volume average particle size of the carrier, the volume average particle size of the toner, the surface area of the carrier and the projection area of the toner, each used in the examples and the comparative examples.

[Volume Average Particle Size of the Carrier]

Approximately 10 mg to 15 mg of a carrier sample for measurement was added to a 10 mL solution having 5% Emulgen 109P (manufactured by Kao Corporation, polyoxyethylene laurylether HLB 13.6). The mixture was dispersed by an ultrasonic dispersing device for one minute. Approximately 1 mL of the mixture thus dispersed was added to a predetermined point of a Micro Trac MT3000 (manufactured by Nikkiso Co., Ltd.) and then stirred for one minute. After it was confirmed that the scattered light intensity became stable, the volume average particle size of the carrier was measured.

[Volume Average Particle Size of the Toner]

Twenty mL of an aqueous solution (electrolyte solution) having 1% (primary) sodium chloride was contained in a 100 mL beaker. Then, 0.5 mL of an alkyl benzene sulfonate (dispersing agent) and 3 mg of a toner sample were successively added to the solution. The mixture was ultrasonically dispersed for 5 minutes thereafter. The water solution having 1% (primary) sodium chloride was added to the mixture so that the total amount was 100 mL. The resultant mixture was ultrasonically dispersed for 5 minutes again, whereby a measurement sample was obtained. With use of the measurement sample thus obtained, the volume average particle size was calculated by a Coulter Counter TA-III (product name, manufactured by Beckman Coulter, Inc.) under the conditions that the aperture diameter was 100 μm and that the particle size measured was 2 μm to 40 μm for each particle.

[Total Surface Area of the Carrier]

The total area of the carrier was calculated from the weight of the carrier mixed, based on the volume average particle size obtained by use of a Micro Trac MT3000 (manufactured by Nikkiso Co., Ltd.), where the specific gravity of the carrier was 4.7.

[Total Projection Area of the Toner]

The number of toner particles corresponding to the weight of the toner mixed was calculated based on the volume average particle size obtained by use of a Coulter Counter (product name: Coulter Counter Multisizer II, manufactured by Beckman Coulter, Inc.), where the specific gravity of the toner was 1.0. Subsequently, multiplication of the number of toner particles by the toner area (calculated on the supposition that the area was circular) returned the total projection area of the toner.

[Measurement and Evaluation]

The following explains the conditions and the evaluation method of measurement performed in connection with use of a developer formed by the carrier and the toner which were prepared as above.

[i. Charge Amount in Initial Stage]

Developers of various combinations of the above toners and carriers were set, one at a time, in a copier (converted from MX-6200N of Sharp Corporation), which contains a development device. After the copier was run idle for 3 minutes at normal temperature and normal humidity, the developers were gathered. Subsequently, the charge amount of each of the developers was measured by use of a suction type charge amount measuring apparatus (210H-2A Q/M Meter, manufactured by TREK Inc.). A developer having a charge amount of not less than −20 μC/g was rated as usable, and one having a charge amount of not less than −25 μC/g was rated as favorable.

[ii. Progression of the Charge Amount at the Rise of Charging]

Developers formed with the carriers (silicone-coated ferrite core carriers, 0.95 g) and the toners (0.05 g) which were prepared as above were contained, one at a time, in a 5 ml glass bottle. After each of the developers was stirred in a 32 rpm rotary cultivator for 1 minute, the developer was gathered. Subsequently, the charge amounts of the developers were measured by use of a suction type charge amount measuring apparatus. The developers were stirred for 3 minutes thereafter, and the charge amounts thereof were measured in the same manner. If the difference between an absolute value of the charge amount after 1 minute of stirring and an absolute value of the charge amount after additional 3 minutes of stirring was not greater than 7 μC/g, the developer was rated as usable. When the above difference was not greater than 5 μC/g, the developer was rated as favorable.

[ii. Attenuation Property of Charge Amount]

Developers formed with the carriers (silicone-coated ferrite core carriers, 76 g) and the toners (4 g) which were prepared as above were contained, one at a time, in a 100 ml polyethylene container. After each of the developers was stirred by use of a 150 rpm ball mill for 60 minutes, the charge amounts of the developers were measured. The developers were then exposed to high temperature and high humidity. Subsequently, the charge amounts of the developers were measured 1 day after, 3 days after and 10 days after. If the difference between an absolute value of the charge amount measured on the first day of the exposure and an absolute value of the charge amount measured on each of the above later days was not greater than 7 μC/g, the developer was rated as usable. If the above difference was not greater than 5 μC/g, the developer was rated as favorable.

[iv. Life Property of Charge Amount]

Developers formed by the toners and the carriers which were prepared as above were set, one at a time, in a copier (MX-6000N of Sharp Corporation), which contains a development device. After 50,000 prints of solid image were produced at normal temperature and normal humidity, (i) the image density in the image area, (ii) the whiteness in the non-image area, and (iii) the charge amounts of the developers were measured. The image density was measure by use of a X-Rite 938 spectrodensitometer. If the image density was not less than 1.4, the developer was rated as favorable. Regarding the whiteness, the tristimulus values X, Y and Z were obtained by use of a SZ90 spectral color difference meter manufactured by Nippon Denshoku Kogyo Co., Ltd. If Z was not greater than 0.7, the developer was rated as usable. If Z was not greater than 0.5, the developer was rated as favorable. The charge amounts of the developers were measured by use of a suction type charged amount measuring apparatus. If the difference between an absolute value of the charge amount before the printing and an absolute value of the charge amount after the printing was not greater than 7 μC/g, the developer was rated as usable. If the above difference was not greater than 5 μC/g, the developer was rated as favorable.

[v. Transfer Rate]

Transfer rates of developers having various combinations of the toners and the carriers which were prepared as above were calculated. The transfer rates T (%) were calculated using the formula below. If the transfer rate T was not less than 90%, the developer was rated as favorable. $T(\%)=[Mp/(Md+Mp)]\times 100$ According to the formula, Mp is the weight of the toner present on a sheet onto which a predetermined chart was printed, and Md is the weight of the toner remaining on the surface of an image forming body (an electrophotographic photoreceptor) after the predetermined chart was printed. The predetermined chart consisted of 4 cm×4 cm patches which were positioned: at the four corners (with a 1.5 cm margin at each side) of an A4 sheet; and at the center thereof.

[vi. Overall Evaluation]

An overall evaluation of the developers was performed by rating: as "A" a developer which was favorable in all of the measurement results in i to v; as "B" a developer which was usable without trouble; and as "C" a developer which was faulty.

The following Table 2 shows the measurement results in i to vi.

oper was rated as good, whereas, if the charge amount was either less than 20 or greater than 50, the developer was rated as poor.

[viii. Image Density]

With use of developers, each weighing 500 g, formed by the toners and the carriers which were prepared as above, the image density of an image sample obtained after 50,000 prints were produced was measured in the same manner as in the measurement described in [iv. Charging Life property] above. The image density was measured by use of a X-Rite 938 spectrodensitometer. The image density of not less than 1.3 was rated as favorable.

TABLE 2

| | | | Charge amount[−μc/g] | | | | | | | | | |
|---|---|---|---|---|---|---|---|---|---|---|---|---|
| | | | | Charging property at the rise | | Attenuation property | | | | Life property | | |
| | Toner | Carrier | Initial stage | 1 min after | 3 min after | 1st day | 1 day after | 3 days after | 10 days after | 50000 copies | Transfer rate | Overall evaluation |
| Example 1 | Toner 1 | Carrier 1 | 28 | 30 | 32 | 28 | 27 | 26 | 26 | 25 | 91 | A |
| Example 2 | Toner 1 | Carrier 2 | 25 | 27 | 30 | 26 | 25 | 24 | 24 | 23 | 92 | A |
| Example 3 | Toner 1 | Carrier 3 | 31 | 33 | 35 | 30 | 28 | 27 | 27 | 28 | 91 | A |
| Example 4 | Toner 1 | Carrier 4 | 21 | 22 | 25 | 20 | 19 | 18 | 18 | 20 | 92 | B |
| Example 5 | Toner 2 | Carrier 1 | 35 | 36 | 40 | 32 | 26 | 25 | 25 | 30 | 93 | B |
| Example 6 | Toner 2 | Carrier 2 | 31 | 32 | 35 | 28 | 26 | 25 | 25 | 29 | 91 | A |
| Example 7 | Toner 2 | Carrier 3 | 25 | 28 | 32 | 25 | 23 | 22 | 22 | 22 | 91 | B |
| Example 8 | Toner 2 | Carrier 4 | 23 | 23 | 26 | 22 | 20 | 20 | 20 | 20 | 92 | B |
| Example 9 | Toner 3 | Carrier 1 | 25 | 26 | 29 | 24 | 22 | 22 | 22 | 22 | 91 | A |
| Example 10 | Toner 3 | Carrier 2 | 29 | 30 | 32 | 30 | 27 | 27 | 27 | 28 | 93 | A |
| Example 11 | Toner 3 | Carrier 3 | 31 | 33 | 35 | 29 | 27 | 26 | 26 | 29 | 92 | B |
| Example 12 | Toner 3 | Carrier 4 | 29 | 30 | 34 | 30 | 28 | 27 | 27 | 27 | 92 | A |
| Comparative Example 1 | Toner 1 | Carrier 5 | 28 | 29 | 31 | 25 | 23 | 21 | 20 | 13 | 91 | C |
| Comparative Example 2 | Toner 1 | Carrier 6 | 27 | 26 | 29 | 28 | 26 | 25 | 18 | 11 | 93 | C |
| Comparative Example 3 | Toner 2 | Carrier 5 | 28 | 28 | 30 | 28 | 26 | 23 | 18 | 14 | 92 | C |
| Comparative Example 4 | Toner 2 | Carrier 6 | 26 | 19 | 21 | 22 | 22 | 19 | 18 | 12 | 92 | C |
| Comparative Example 5 | Toner 4 | Carrier 1 | 30 | 28 | 29 | 28 | 27 | 26 | 26 | 27 | 82 | C |

As illustrated in Table 2, Examples 1 to 12 indicate that the inclusion of a conductive agent and a charge control agent in the coating of the carrier stabilizes the charging property at the rise of charging, the attenuation property and the charging life property, regardless of whether a color toner or a black toner is in use.

Comparative Examples 1 to 4 indicate that the life property significantly decreases when the coating of the carrier includes neither a conductive agent nor a charge control agent.

Further, it is evident that, in a case where the amount of external additives included in the coating is less than 0.1 μm, the transfer efficiency is poor although the charging property and the life property are favorable.

In addition to the above, the following measurement was made. The conditions and the evaluation method of the measurement will be explained below.

[vii. Charge Amount]

Developers, each weighing 20 g, formed by the toners and the carriers which were prepared as above were contained, one at a time, in a 100 cc plastic bottle, and stirred on a double-roll kneader. The charge amounts one hour after were measured by use of a charge amount measuring apparatus (manufactured by Trek Inc.). If the charge amount thus measured was not less than 20 and not greater than 50, the devel-

[ix. Stability in Environmental Conditions]

Each of the developers formed by the toners and the carriers was placed in a developing tank in predetermined amount. Each of the developers was kept (a) at a temperature of 5° C. and a humidity of 10% for a whole day, and (b) at a temperature of 35° C. and a humidity of 80% for another whole day. Subsequently, the developers were spun at the same rotation speed as in an image forming apparatus (converted from MX-6200). The charge amounts of the toners were then measured. Thereafter, the relative ratio (rate of change) of the charge amount of the toner under the cold and dry condition (a) to that of the toner under the hot and humid condition (b) was calculated for evaluation. The relative ratio of not greater than 75% was rated as good, whereas that of greater than 75% was rated as poor.

TABLE 3

| | Examples | | | Comparative examples | | |
|---|---|---|---|---|---|---|
| | 13 | 14 | 15 | 6 | 7 | 8 |
| Carrier | 1 | 4 | 3 | 5 | 5 | 1 |
| Carrier volume average particle size (μm) | 35 | 55 | 90 | 45 | 45 | 35 |

TABLE 3-continued

| | | Examples | | | Comparative examples | | |
|---|---|---|---|---|---|---|---|
| | | 13 | 14 | 15 | 6 | 7 | 8 |
| Amount of toner mixed (part) | | 4.7 | 5.0 | 4.3 | 3.7 | 3.1 | 11.9 |
| Area ratio (%) | | 30 | 50 | 70 | 30 | 25 | 75 |
| Ratio of volume average particle size | | 5.4 | 8.5 | 13.8 | 6.9 | 6.9 | 5.4 |
| Charge amount (q/m) | Value | 28 | 31 | 24 | 19 | 33 | 18 |
| | Evaluation | Good | Good | Good | Poor | Good | Poor |
| Image density | Value | 1.4 | 1.5 | 1.3 | 1.4 | 1.3 | 0.9 |
| | Evaluation | Good | Good | Good | Good | Good | Poor |
| Stability in environmental conditions | Value | 88 | 85 | 90 | 70 | 74 | 78 |
| | Evaluation | Good | Good | Good | Poor | Poor | Good |

As is evident from Table 3, with the use of a developer in which the carrier includes conductive particles in the resin coating hereof, the charge amount is stabilized when the developer has (i) an area ratio (i.e. total toner projection area/total carrier surface area) of 30% to 70%, and (ii) a ratio of volume average particle size (i.e. volume average particle size of the carrier/volume average particle size of the toner) of not less than 5. Further, it is evident from Comparative Example 6, inclusion of the carrier (5), whose resin coating lacks conductive particles, in a developer decreases the charge amount and consequently the image density. Still further, it is evident from Comparative Example 7, the carrier-to-toner ratio of not greater than 30% leads to instability in environmental conditions. Furthermore, it is evident from Comparative Example 8 that the carrier-to-toner ratio of greater than 70% decreases the charge amount, and that, as a result, a desired image density is unobtainable.

The carrier, the developer, the development device, the image forming apparatus and the image forming method, each according to the present invention, are preferably applicable to image forming apparatuses such as an electrophotographic copier, printer and facsimile machine.

As described above, the carrier of the present invention is used in a developer, the developer including the carrier and a toner which includes at least a binder resin and an organic colorant, wherein the carrier has a core and a coating formed on a surface of the core, the coating including (i) a charge control agent for controlling a charge whose polarity is a same as a polarity of a charge controlled by a charge control agent included in the toner, and (ii) conductive particles.

In addition to the above arrangement, the carrier of the present invention may be arranged such that the coating is formed from a resin composition in which resin includes at least one of a silicone resin and a denatured resin thereof.

According to the above arrangement, the coating of the carrier is formed from a resin composition in which resin includes at least one of a silicone resin and a denatured resin thereof. This provides the coating with both a releasing property with respect to the toner and adhesiveness to the carrier core. As a result, the effect of stably and continuously charging the toner can be realized more significantly.

In addition to the above arrangement, the carrier of the present invention may be arranged such that the core is a ferrite core.

According to the above arrangement, the use of a ferrite as a core yields great charging performance, excellent durability and proper saturation magnetization. Further, the use thereof facilitates coating the core with the silicone resin composition.

In addition to the above arrangement, the carrier of the present invention may be arranged such that the core has a volume average particle size in a range from 25 μm to 100 μm.

According to the above arrangement, the use of the core having a volume average particle size in a range from 25 μm to 100 μm allows the toner to be carried stably in a developer which includes the carrier of the present invention, and thereby allows a high-resolution image to be formed.

In addition to the above arrangement, the carrier of the present invention is so arranged that the charge control agent included in the coating is devoid of heavy metal.

According to the above arrangement, the use of the charge control agent in the coating which charge control agent is devoid of heavy metal, in a case where the coating is formed from a resin composition, does not decrease the mechanical strength of the resin when the charge control agent is supplied to the resin.

Inclusion of a charge control agent in the resin included in the resin composition which forms the coating is effectively achieved by dissolving the charge control agent in an organic solvent and then mixing the solvent with a resin solution so that the charge control agent is dispersed. Use of an alcohol solvent, however, decreases the mechanical strength of the resin. Thus, a charge control agent including heavy metal, which is well soluble in an alcohol solvent, is not preferable. On the other hand, a charge control agent devoid of heavy metal, which is soluble in a ketone solvent, can be included in the resin without decreasing the mechanical strength of the resin; therefore, such a charge control agent is preferable.

In addition to the above arrangement, the carrier of the present invention may be arranged such that a ratio of the conductive particles to the resin included in the resin composition is not greater than 30 parts by weight to 100 parts by weight.

According to the above arrangement, since the ratio of the conductive particles included in the coating of the carrier to the resin included in the resin composition is not greater than 30 parts by weight to 100 parts by weight, the carrier has a further improved charge donating property with respect to the toner. Furthermore, the mechanical strength of the coating, the adhesiveness thereof to the ferrite particle and the like property are improved as well. This allows the carrier to facilitate stable and continuous charging of the toner. Additionally, the resistivity of the conductive particle is preferably not greater than $10^{10}$ Ω·cm.

In addition to the above arrangement, the carrier of the present invention may be arranged such that a ratio of the charge control agent to the resin included in the resin composition is in a range from 0.1 to 20 parts by weight to 100 parts by weight.

According to the above arrangement, since the ratio of the charge control agent included in the coating of the carrier to the resin included in the resin composition is in a range from 0.1 to 20 parts by weight to 100 parts by weight, the charge supply from the coating can be maintained continuously.

With the aim of solving the above problem, the developer of the present invention includes: one of the carriers described above; and a toner which includes at least a binder resin and an organic colorant.

The above arrangement yields the same effect as above and allows provision of the developer that is capable of stably charging the toner irrespective of the number of sheets printed. The use of such a developer results in stable formation of a high-quality image which has high-resolution image reproduction, favorable color reproduction, high image density and few image defects such as a photographic fog.

In addition to the above arrangement, the developer of the present invention may be arranged such that at least two or more kinds of particles having different particle sizes are added to the toner with the particles attached to a surface of the toner.

The external addition of two or more kinds of particles having different particle sizes with the particles attached to the surface of the toner increases the fluidity of the toner effectively.

In addition to the above arrangement, the developer of the present invention may be arranged such that at least one kind of the particles added to the toner with the particles attached to the surface of the toner has a primary particle size of not less than 0.1 μm and not greater than 0.2 μm.

The external addition of at least one kind of the particles to the toner which kind has a primary particle size of not less than 0.1 μm and not greater than 0.2 μm increases the fluidity of the toner further effectively. Generally a particle having such a large particle size inhibits contact between the toner and the carrier. However, since the developer of the present invention includes one of the above carriers, the use of at least one kind of the particles to be added to the toner which kind has a primary particle size of not less than 0.1 μm and not greater than 0.2 μm does not inhibit improvement in the transferring property or cause a loss in the charging property arising from the external additive adherent to the surface of the carrier. The use of the developer having the above arrangement, therefore, allows the toner to be charged stably and continuously. Such an effect is exerted particularly when a color toner is used.

In addition to the above arrangement, the developer of the present invention may be arranged such that a ratio of a volume average particle size of the carrier to a volume average particle size of the toner is not less than 5, and a mixing ratio of a total projection area of the toner to a total surface area of the carrier is in a range from 30% to 70%.

The use of the carrier and the toner at the above ratio and the mixing ratio further increases stability of the charge donating property with respect to the toner (i.e. the charging property of the toner). The application of the developer having the above arrangement to a high-speed electrophotographic image forming apparatus minimizes the toner consumption, and allows a high-resolution, high-density, high-quality image to be formed stably.

With the aim of solving the above problems, the development device of the present invention performs development with use of one of the above developers. Such a development device is capable of performing development with the charge amount of the toner stabilized and brings the same effect as above.

With the aim of solving the above problem, the image forming apparatus of the present invention includes the development device and transfer means including an intermediate transfer member, on which a plurality of toner images having different colors are formed.

According to the above arrangement, the use of the developer of the present invention stabilizes the charge amount of the toner. The effect of the above carrier and developer is exerted further effectively in such a mechanism that a toner image is transferred twice with use of an intermediate transfer member.

With the aim of solving the above problems, the image forming method of the present invention is a method for forming a polychrome image with use of one of the above developers.

According to the above method, the use of the developer of the present invention enables stable and continuous formation of a high-resolution, high-density, polychrome image which exhibits excellent image reproduction including color reproduction.

The above image forming method may be such that transfer is performed with use of an intermediate transfer method in which a plurality of toner images having different colors are formed on an intermediate transfer member.

The use of the developer of the present invention stabilizes the charge amount of the toner. The effect of the above carrier and developer is exerted further effectively in such a method that a toner image is transferred twice with use of an intermediate transfer method.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A developer, comprising:

a carrier; and a toner which includes at least a binder resin and an organic colorant, wherein the carrier has a core and a coating formed on a surface of the core, the coating including (i) a charge control agent for controlling a charge whose polarity is a same as a polarity of a charge controlled by a charge control agent included in the toner, and (ii) conductive particles, the coating is formed from a resin composition in which resin includes at least one of a silicone resin and a denatured resin thereof, and a ratio of a volume average particle size of the carrier to a volume average particle size of the toner is not less than 5, and a mixing ratio of a total projection area of the toner to a total surface area of the carrier is in a range from 30% to 70%.

2. The developer according to claim 1, wherein the coating includes a silane coupling agent.

3. The developer according to claim 2, wherein the silane coupling agent contains an amino group.

4. The developer according to claim 1, wherein the core is a ferrite core.

5. The developer according to claim 1, wherein the core has a volume average particle size in a range from 25 μm to 100 μm.

6. The developer according to claim 1, wherein the charge control agent included in the coating is devoid of heavy metal.

7. The developer according to claim 1, wherein a ratio of the conductive particles to the resin included in the resin composition is not greater than 30 parts by weight to 100 parts by weight.

8. The developer according to claim 1, wherein a ratio of the charge control agent to the resin included in the resin composition is in a range from 0.1 to 20 parts by weight to 100 parts by weight.

9. The developer according to claim 1, wherein at least two or more kinds of particles having different particle sizes are added to the toner with the particles attached to a surface of the toner.

10. The developer according to claim 9, wherein at least one kind of the particles added to the toner with the particles attached to the surface of the toner has a primary particle size of not less than 0.1 μm and not greater than 0.2 μm.

11. A development device performing development with use of the developer according to claim 1.

12. An image forming apparatus, comprising:

the development device according to claim 11; and transfer means including an intermediate transfer member, on which a plurality of toner images having different colors are formed.

13. An image forming method for forming a polychrome image with use of the developer according to claim 1.

14. The image forming method according to claim 13, wherein transfer is performed with use of an intermediate transfer method in which a plurality of toner images having different colors are formed on an intermediate transfer member.

15. The developer according to claim 1, wherein a weight ratio (Si/C) of the silicon to the carbon in the silicone resin is from 0.3 to 2.2.

* * * * *